US005415153A

United States Patent [19]

Johnson et al.

[11] Patent Number: 5,415,153

[45] **Date of Patent: * May 16, 1995**

[54] PRESSURIZED AIR/WATER ROCKET AND LAUNCHER

[76] Inventors: Lonnie G. Johnson, 4030 Ridgehurst Dr., Smyrna, Ga. 30080; Bruce M. D'Andrade, 3 Ten Eyck Rd., Whitehouse Station, N.J. 08889

[ * ] Notice: The portion of the term of this patent subsequent to Mar. 30, 2010 has been disclaimed.

[21] Appl. No.: 191,964

[22] Filed: Feb. 4, 1994

Related U.S. Application Data

[63] Continuation-in-part of Ser. No. 902,079, Jun. 22, 1992, abandoned.

[51] Int. Cl.[6] ..... F41B 11/00; A63H 27/26

[52] U.S. Cl. ..... 124/63; 124/57; 124/75; 446/212

[58] Field of Search ..... 446/211, 212, 56, 180, 446/186, 187; 124/63-65, 69, 57, 58, 60, 56, 75

[56] References Cited

U.S. PATENT DOCUMENTS

| | | | |
|---|---|---|---|
| 2,733,699 | 2/1956 | Krinsky . | |
| 2,927,398 | 3/1960 | Kaye et al. . | |
| 3,121,292 | 2/1964 | Butler et al. | 446/212 |
| 3,736,836 | 6/1973 | McAllister | 446/212 X |
| 3,740,896 | 6/1973 | Glass et al. | 446/212 |
| 3,962,818 | 6/1976 | Pippin, Jr. . | |
| 4,223,472 | 9/1980 | Fekete et al. | 446/196 X |
| 4,411,249 | 10/1983 | Fogarty et al. | 124/64 |
| 4,897,065 | 1/1990 | Fertig et al. | 446/63 |
| 5,032,100 | 7/1991 | Goldfarb | 446/187 |
| 5,197,452 | 3/1993 | Johnson et al. | 446/212 X |

FOREIGN PATENT DOCUMENTS

| | | | |
|---|---|---|---|
| 1330882 | 5/1963 | France | 446/212 |

*Primary Examiner*—Mickey Yu
*Attorney, Agent, or Firm*—Kenneth P. Glynn

[57] ABSTRACT

The present invention involves a liquid jet propelled rocket and rocket launcher. The launcher has a housing which includes a vessel for holding pressurized air therein, an inlet to the vessel and an outlet from the vessel. Also, the housing has a jet tube receiver extending from the outlet and adapted to connect with a jet tube of a rocket assembly. A pump is connected to the vessel inlet of the housing, the pump is connected for and capable of pumping air into the vessel at a pressure sufficient to launch the rocket assembly. A one way valve is connected to the pump and permits the flow of air only from the pump to the vessel. There is a rocket assembly latch mechanism located on the housing with means for releasing the latch. There are also, a rocket assembly which includes a liquid reservoir for receiving liquid and subsequently receiving air under pressure from the pump, a jet tube extending from the liquid reservoir and adapted to sealably and releasably connect to said jet tube receiver of the housing. The rocket assembly with the jet tube is releasably attachable to the housing with the jet tube coupled in fluid communication with the jet tube receiver by the latch mechanism, wherein the liquid may be stored within the rocket reservoir, and air may be pumped into the rocket reservoir and into the launcher vessel by means of actuating the pump.

20 Claims, 4 Drawing Sheets

PRESSURIZED AIR/WATER ROCKET AND LAUNCHER

REFERENCE TO RELATED CASES

This is a continuation in part of United States patent application Ser. No. 07/902,079 filed on Jun. 22, 1992, entitled "Pressurized Air/Water Rocket Launcher and Rocket", by the same inventors herein, now abandoned.

BACKGROUND OF THE INVENTION

1. Field of the Invention

The present invention is directed to a liquid jet propelled rocket launcher and rocket. More specifically, it is directed to a toy which propels a rocket in a generally upward direction by a liquid-air propulsion combination. Further, the present invention utilizes a rocket with a liquid reservoir, a pump and a pressurized base vessel whereby pressurized air is pumped into the rocket reservoir and into the base vessel, and the rocket is subsequently released for propulsion. Thus, the present invention pertains in general to motive type rockets which are launched by hand operation and no chemicals, motors, batteries or other power is required.

2. Prior Art Statement

Toys involving launchers have been around for at least thirty or forty years and apparently emerged with modern rocketry, although not all such toys pertain directly to rockets. Over the years various types of jet-powered toys have been developed which rely upon pressurized liquid within a container in the projectile or transporter and/or rely upon pneumatic launching.

U.S. Pat. No. 2,733,699 issued to B. Krinsky describes a rocket toy using a pressurized launcher and a spring mechanism for initial thrust. Pressurized air is created by a hand pump and a resilient washer (42) is used to retard launching until adequate pressure is achieved.

U.S. Pat. No. 2,927,398 issued to Kaye et al describes a multi-stage rocket in which fluid within chambers in each of multiple stages of a rocket are pressurized and sequentially released. Similarly, U.S. Pat. No. 3,962,818 issued to Reginald Pippin describes a multi-stage rocket with mechanisms for pressurizing liquid within containers for each stage.

U.S. Pat. No. 3,740,896 to Marvin Glass et al describes a jet-powered vehicle wherein a wheeled vehicle has a chamber or container within it and has a launching device which includes an air pump with a one-way valve. There is also clamp means for holding the vehicle in the charging position and a trigger means for releasing the clamping device following the charging of the chamber to permit the vehicle to be propelled by means of reaction of the jet drive.

U.S. Pat. No. 4,223,472 describes a toy missile launching device which utilizes pressurized air. It involves a complex system which includes a large launching guide pipe, a complex mechanical release mechanism and a three position valve member for a complex pumping and launching.

U.S. Pat. No. 4,411,249 issued to Bonnie Fogarty et al describes a toy glider with a pneumatic launcher. In this device, a wristlet includes a pumping mechanism as well as a flexible conduit to which a glider may be attached. The pump is used to pressurize and pneumatically project the glider.

U.S. Pat. No. 4,897,065 issued to John Fertig describes a toy vehicle and hand held pneumatic launcher wherein the pumping mechanism has a piston and hollow cylinder designed for a particular type of grip of a child coupled with thumb or hand operation of the pump mechanism.

U.S. Pat. No. 5,032,100 issued to Adolf Goldfarb describes a toy vehicle and launcher which uses contractive power of liquid in a liquid expanded chamber to propel the vehicle. Here, a significantly large reservoir is utilized to fill and expand a bladder which is connected to and part of a transporter or toy vehicle. It is the expanded, pressurized bladder with the air and water mixture which propels the vehicle as a result of the contraction of the bladder upon release of the vehicle.

Notwithstanding the prior art in this field, no patent teaches or renders obvious the present invention device which utilizes a pressurized launcher with a rocket which has a reservoir which holds a predetermined amount of liquid. The reservoir is also pressurized so as to create a predetermined volume mixture of liquid and air to maximize a two step liquid jet propulsion of the rocket upon launching.

SUMMARY OF THE INVENTION

The present invention involves a liquid jet propelled rocket and rocket launcher. The launcher has a housing which includes a vessel for holding pressurized air therein, an inlet to the vessel and an outlet from the vessel. Also, the housing has a jet tube receiver extending from the outlet and adapted to connect with a jet tube of a rocket assembly. A pump is connected to the vessel inlet of the housing, the pump is connected for and capable of pumping air into the vessel at a pressure sufficient to launch the rocket assembly. A one way valve is connected to the pump and permits the flow of air only from the pump to the vessel. There is a rocket assembly latch mechanism located on the housing with means for releasing the latch. There are also, a rocket assembly which includes a liquid reservoir for receiving liquid and subsequently receiving air under pressure from the pump, a jet tube extending from the liquid reservoir and adapted to sealably and releasably connect to said jet tube receiver of the housing.

The rocket assembly with the jet tube is releasably attachable to the housing with the jet tube coupled in fluid communication with the jet tube receiver by the latch mechanism, wherein the liquid may be stored within the rocket reservoir, and air may be pumped into the rocket reservoir and into the launcher vessel by means of actuating the pump. In addition, a substantial positive air pressure may be created within the rocket reservoir and within the vessel, after which the rocket assembly may be released by the release means and may advance away from the housing by the pressurized air in the vessel and by jet propulsion of the liquid and air contained within the rocket reservoir. In preferred embodiments the water to air ratio and the air pressure itself are such that the rocket assembly is launched in two different discrete phases, one being a positive air pressure thrust by the pressurized vessel and the other being a combination of air and liquid such as water to create a jet stream thrust from the rocket assembly.

BRIEF DESCRIPTION OF THE DRAWINGS

The present invention as described herein will be more fully understood and appreciated when taken in conjunction with the drawings appended hereto those drawings are as follows.

DETAILED DESCRIPTION OF THE INVENTION

The present invention toy has been developed to create a rocket assembly which is jet propelled and which may be launched by hand preferably utilizing a mixture of liquid (typically water) and air, e.g. a predetermined ratio, in a rocket assembly reservoir and enabling the user to effectively accomplish this in a manner which utilizes an air pressure built up in both a rocket assembly and a launcher, followed by jet propulsion caused by pressurized air with water exiting from the rocket assembly for thrust. Uniquely, the present invention toy includes a launcher which has a housing with a pressurizeable vessel, as well as a reservoir on the rocket assembly for additional pressurization. The rocket reservoir has a volume for a predetermined amount of liquid, with space left for air and subsequent pressurization.

Thus, it is an object of the present invention to provide an advanced toy for launching rocket assemblies and similar substantially vertically launched aerodynamic projectiles and any other form of substantially vertically launched transporters, which can be imagined or may yet to be developed in an exciting and efficient manner. (Thus the words "rocket" and "rocket assembly" should be taken to mean substantially vertically launched aerodynamic projectiles or transporters.)

Figure 1A:
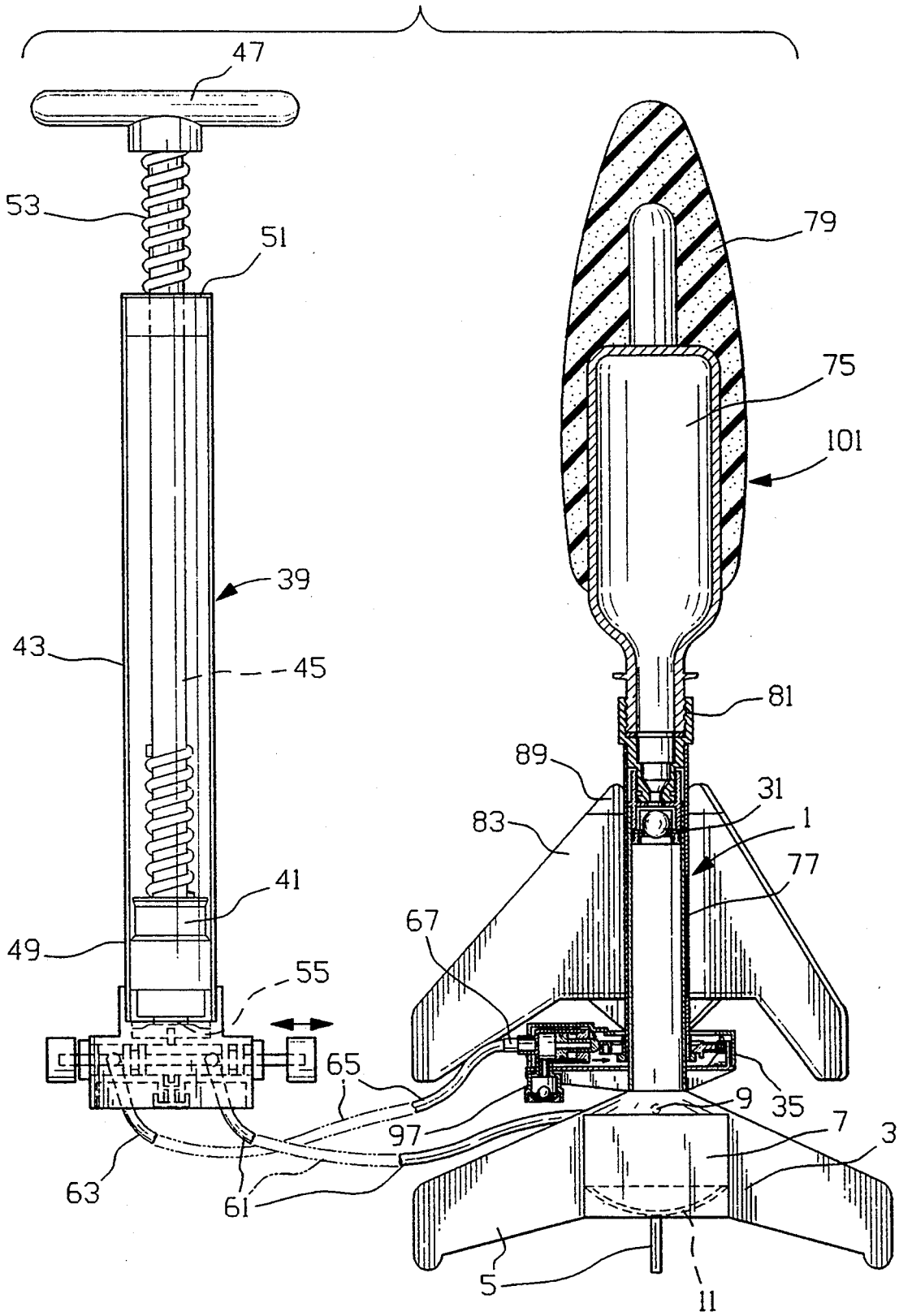
FIGS. 1(*a*), 1(*b*) and 1(*c*) show front elevation views, partially in vertical cross section, of a present invention toy, including a pump, a launcher and a liquid jet propelled rocket assembly.
Figure 1B:
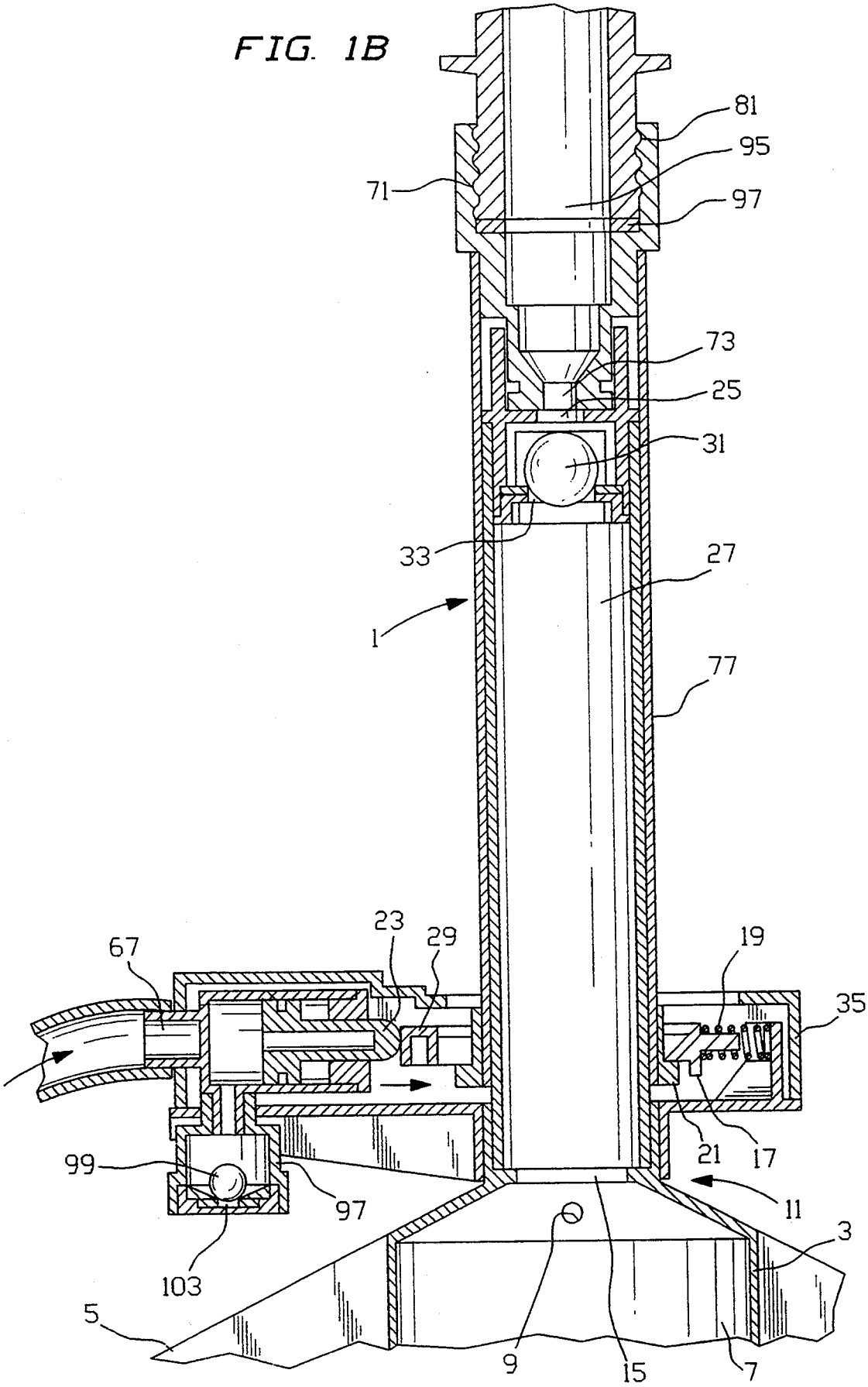
Figure 1C:
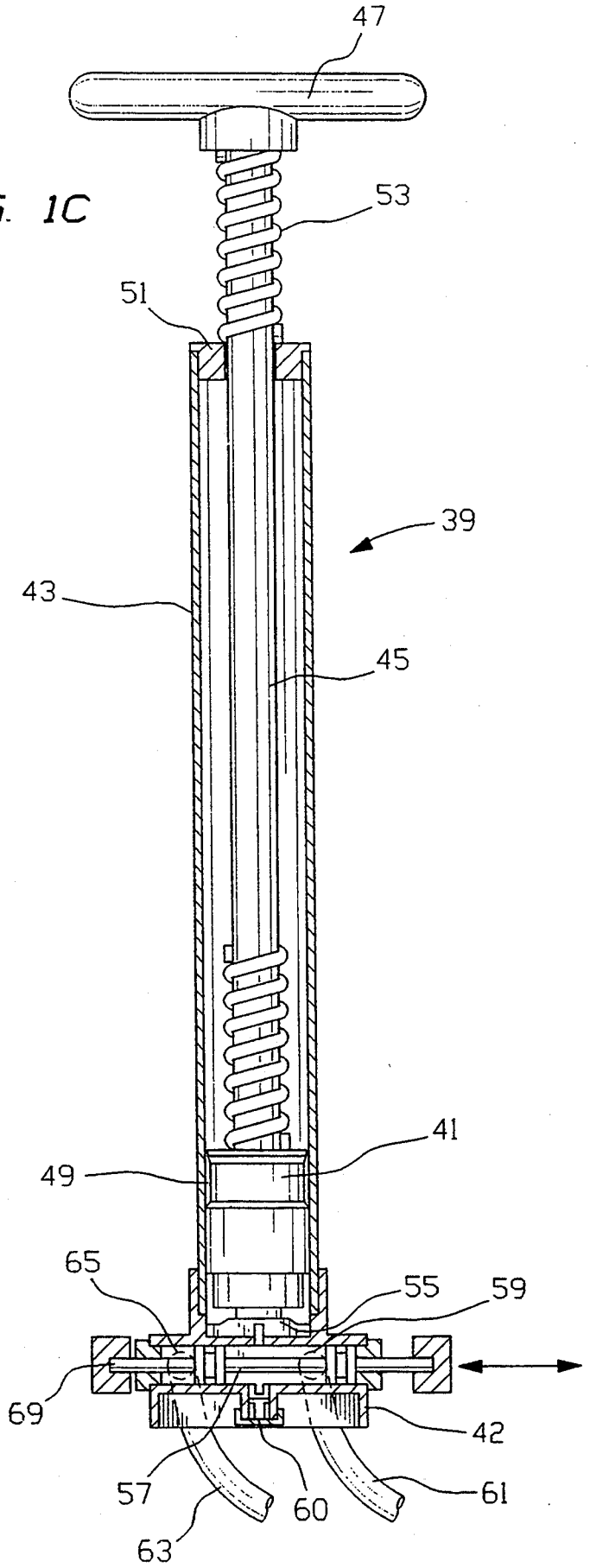
Figure 2:
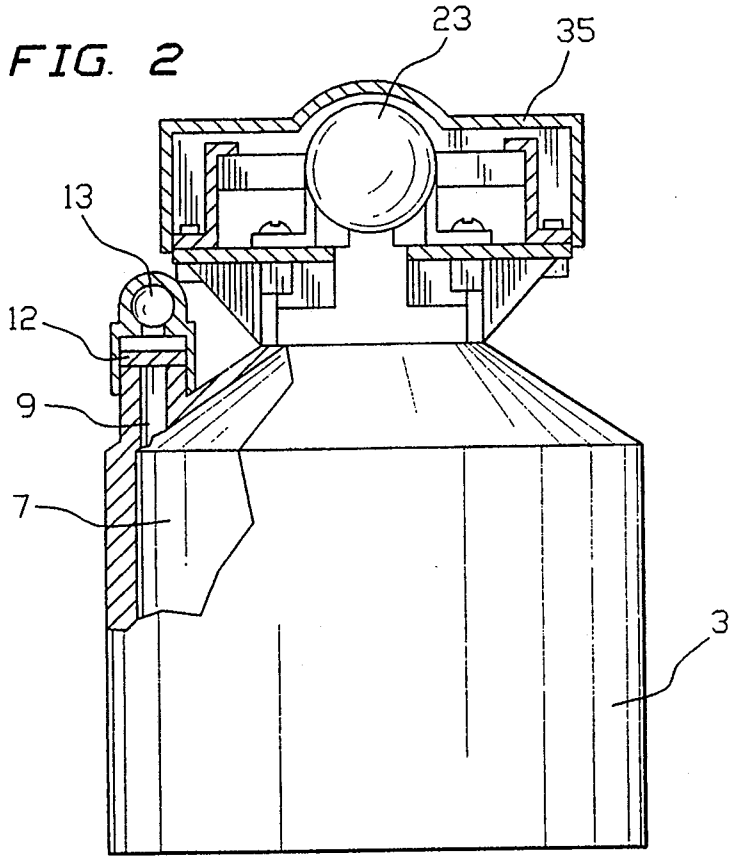
FIG. 2 is a partial side elevation view, partially in vertical cross-section, of a present invention launcher base.

Referring now to FIGS. 1(*a*), 1(*b*), 1(*c*) and 2, there is shown in FIGS. 1(*a*) and 1(*b*) front elevation views, partially in vertical cross-section, of a present invention toy 1, including a launcher 11, rocket assembly 101 and pump 39. FIG. 1(*b*) shows an enlargement of a portion of the launcher and rocket assembly and FIG. 1(*c*) shows an enlargement of the pump system. In FIG. 2 is shown a partial side elevation view, partially in vertical cross-section, of a present invention launcher base (without showing supports such as supports 5). Launcher 11 includes launcher housing 3 which has a plurality (e.g. three) base supports such as base supports 5 for support and stability as well as a housing vessel 7. Vessel 7 includes a vessel inlet 9 which includes attachment stem 13 shown in FIG. 2. Also shown in FIG. 2 is one way check valve 12 which allows air to flow into vessel 7 but, when vessel 7 is pressurized, prevents air from exiting vessel 7 through inlet 9.

Facing upwardly from housing 3 is vessel outlet 15 connected directly to jet tube receiver 27. As will be discussed below, the jet tube receiver 27 receives jet tube 77 of rocket assembly 101. Jet tube receiver 27 includes an outlet 25, as shown. Additionally, jet tube receiver 27 is itself an annulus or tubing or piping configuration and has a one way valve 31 which opens only to upward flow (e.g. air) through orifice 33.

The housing 3 also includes a rocket assembly latch mechanism 17 which is biased by spring 19 to latch over lip 21. Release means 23 is slidably moveable left to right and vice versa as shown in FIGS. 1(*a*) and 1(*c*). Release means 23 may be pushed against end 29 of latch mechanism 17 to release an otherwise latched rocket assembly for launching (discussed further below). Safety features such as encasement 35 prevent or deter premature or accidental launching by securing release mechanism 17 from accidental contact.

Also, shown in FIG. 1(*c*) is pump 39 with pump piston support 42 which includes a piston chamber 43 and a piston rod 45 and a piston 41. Piston pump handle 47 extends beyond the outer end of piston rod 45 and may be reciprocated so as to pump air into the vessel 7 through one way O-ring valve 49 located around piston 41 and connected thereto, as shown. Piston housing cap 51 supports piston rod 45 and handle 47. Optional spring 53 acts as a shock absorber between handle 47 and cap 51 during pumping. Air is taken into piston chamber 43 at the opening around piston rod 45 at cap 51. This occurs when piston pump handle 47 is pulled outwardly and O-ring valve 49 moves away from the sealing position and allows air to pass by piston 41 such that air fills piston chamber 43. When piston pump handle 47 is pushed inwardly, the air within the piston housing is forced by one way O-ring valve 49 past one way valve 55, through cavity 57 located in support 42 through outlet 59, down flexible tubing 61 and into vessel inlet attachment stem 13, into vessel inlet 9 and into vessel 7. The air also travels up jet tube receiver 27 and into rocket propulsion reservoir 75 of rocket assembly 101. Further pumping increases the air pressure in the vessel 7 and in the reservoir 75 of the rocket assembly for subsequent propulsion. However, if a predetermined maximum acceptable pressure is reached, pressure release valve 60 prevents further pressure build up.

Release means 23 is, as mentioned, slidably mounted so that it may be pushed into end 29 of latch mechanism 17. When jet tube 77 of the rocket assembly 101 is inserted onto jet tube receiver 27, it may be secured in place via latch mechanism 17. When the rocket propulsion reservoir 75 has water and the rocket propulsion reservoir of rocket assembly 101 and vessel 7 of launcher 11 are fully pumped up, e.g. with 60, 70, 80 or higher p.s.i., the user could press a release mechanism to launch. But here, a safety advantage is achieved because release means 23 is activated remotely. Flexible tubing 63 connects a second outlet 65 from pump piston support 42 to release inlet 67 of launcher 11.

When spool valve 69 (or its equivalent) is shifted from right to left, air pressurizes tubing 63 instead of tubing 61 and pushes on release means 23 to release latch mechanism 29. This causes rocket assembly 101 to launch and be propelled, first by the air pressure in the launcher vessel 7 of the rocket assembly 101, and then by subsequent pressure release from inside jet tube 77 and rocket propulsion reservoir 75. The initial air pressure from the launcher may be only for a fraction of a second or so while the released pressure and water jet stream from the jet tube 77 and reservoir 75 may last for a number of seconds, e.g. 10 or 20 seconds or more.

Rocket assembly 101 includes jet tube 77 with constricted jet orifice 73, and threads 71, for receiving reservoir 75. In this case there is a foam cover for rocket propulsion reservoir 75, as shown. Reservoir 75 includes threads 81 at orifice 95 for connection to jet tube threads 71. Rocket assembly 101 is in the form of a simulated vehicle, in this case a rocket with fins such as fin 83 and brackets such as bracket 89. The fins such as fin 83 may be removable, as here. While attachment of the reservoir 75 is by threading, the threads are not essential and a snap on, clamped or sealed arrangement would work sufficiently. Propulsion reservoir orifice 95 attaches to constricted jet orifice 73 with a tight seal via washer 97.

A user fills reservoir 75 with water to 50%, 60%, or so, of capacity while inverted (orifice 95 upward), and screws it onto jet tube 77. The thus assembled rocket assembly 101 is then inverted and placed on jet tube receiver 27. The assembly 101 is then snapped into a latched position and releasably latched by latch mechanism 17. Air is pumped via pump 39 into the launcher vessel 7, the jet tube receiver 27 and the rocket propulsion reservoir 75 and through the various connecting means. Valve 31 prevents water from emptying into vessel 7 from reservoir 75. When the pump has been actuated a predetermined number of counts, e.g., twenty, the toy 1 is ready for launching.

The user next switches spool valve 69 by pressing or pulling it to the opposite position from that shown in FIG. 1(*c*). By so doing, the user closes off outlet 59 and opens outlet 65. Further pumping increases air pressing in tubing 63 and this continues to increase until adequate pressure is achieved to overcome the force of spring 19, thereby pushing latch mechanism 17 to the open position and launching rocket assembly 101 as previously described. This pump releasing means adds significant play value to the toy, as it simulates the plunger activated detonation of explosives as frequently depicted in animations.

Significant safety advantages are achieved by the embodiment of the present invention shown in FIGS. 1 and 2. As mentioned, encasement 35 prevents direct release of latch mechanism 17 and encourages remote release via pump 39. Further, the "soft" rocket assembly 101, comprising reservoir 75 covered with a foam nose cone 79, limits any injury which could occur from accidental impact to a user or other person or property in the area. Further, a "tilt switch" 97 which would prevent release of the rocket unless it were kept in a substantially vertical position. This includes a ball valve 99 at outlet 103. If toy 1 is tilted to an angle of greater than, say about 15° from the vertical or aimed at someone, or falls over, ball valve 99 will unseat and pressure pumped into tubing 63 will exit through outlet 103 and the user will be unable to release latch mechanism 17. While this is an optional feature, it will prevent the use of the toy for firing at other people.

Figure 3A:
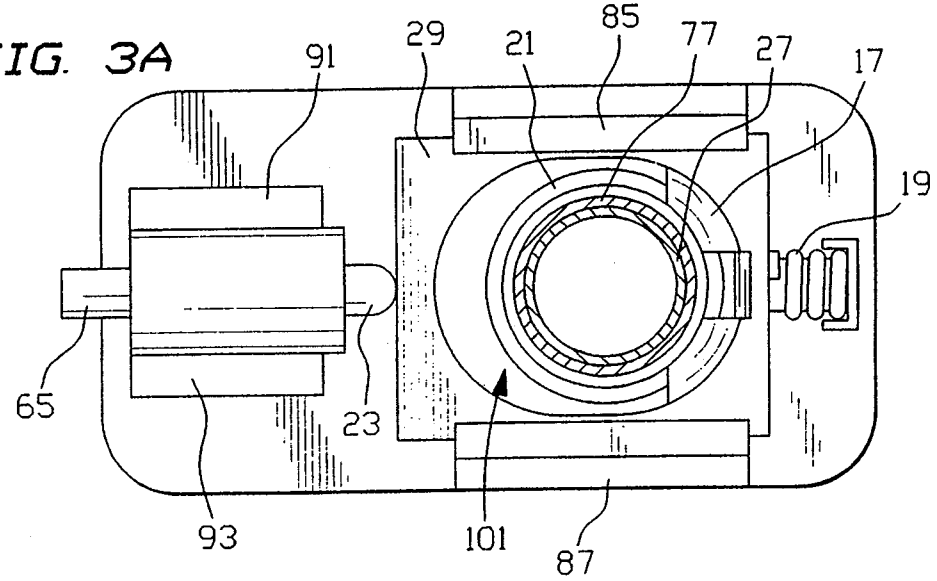
FIGS. 3*a* and 3*b* show partial sectional views of a portion of the launcher shown in FIGS. 1*a*, 1*c* and 2 to illustrate the launch release mechanism.
Figure 3B:
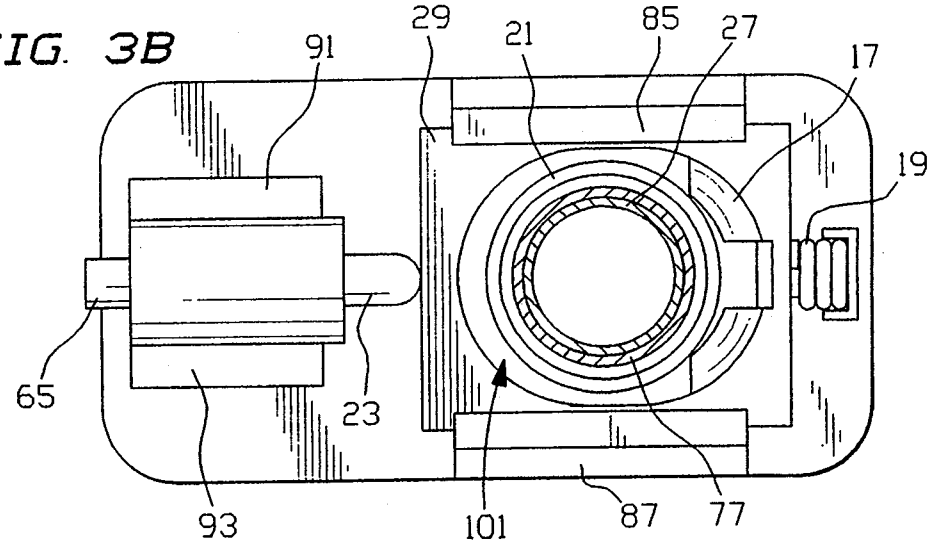

FIG. 3a shows a partial sectional view of a portion along line 3—3 of FIG. 1 of launcher 11 with the upper part of encasement 35 removed. Parts identical to those shown in FIG. 1 are identically numbered. Guides 85 and 87 support latch mechanism 17 allowing it to be moved from left to right and vice versa, although it is biased to the left in its resting and latching position via spring 19. Similarly, release means 23 is reciprocally movable within mounting flanges 91 and 93. In this FIG. 3*a* and in FIG. 3*b*, rocket assembly 101 is shown in cut view and jet tube receiver 27, jet tube 77 and lip 21 are shown. In FIG. 3*a*, latch mechanism 17 is over lip 21 of jet tube 77 and rocket assembly 101 are secured. When release means 23 is moved to the right as shown in FIG. 3*b*, latch mechanism 17 is moved off lip 17 and rocket assembly 101 is released to launch with the thrust discussed above.

The construction of the present invention toy is, typically, of various types of plastic and, once the invention is appreciated, the selection of soft and hard plastics for various components will be within the skill of the artisan. For example, high density polyethylene may be used for certain aspects whereas other plastics may be utilized, for example, tubing could be typical vinyl tubing and the fittings could be hard rubber fittings or otherwise. Additionally, some or all parts may be made of other materials such as materials typically available in the construction of toys, including rigid and flexible foams, metals, graphite, etc.

Obviously, numerous modifications and variations of the present invention are possible in light of the above teachings. It is therefore understood that within the scope of the appended claims, the invention may be practiced otherwise than as specifically described herein.

What is claimed is:

1. A liquid jet propelled rocket launcher and rocket toy, which comprises:

(a) a launcher having a housing which includes a vessel for holding pressurized air therein, an inlet to said vessel and an outlet from said vessel, said inlet and said outlet being separate; said housing further comprising a jet tube receiver extending from said outlet and adapted to connect with a jet tube of a rocket assembly;

(b) a pump connected to said vessel inlet of said housing, said pump being connected for and capable of pumping air into said vessel at a pressure sufficient to launch a rocket assembly;

(c) a first one way valve connected to said pump and permitting flow of air only from said pump to said vessel;

(d) a rocket assembly latch mechanism located on said housing;

(e) means for releasing said latch mechanism;

(f) a rocket assembly which includes a rocket reservoir for receiving liquid and subsequently receiving air under pressure from said pump by way of said launcher housing, a jet tube extending from said rocket reservoir and adapted to sealably and releasably connect to said jet tube receiver of said housing;

wherein said rocket assembly with said jet tube is releasably attachable to said housing with said jet tube coupled in fluid communication with said jet tube receiver by said latch mechanism, wherein liquid may be stored within said rocket reservoir, and air may be pumped into said rocket reservoir and into said launcher vessel by means of actuating said pump and further wherein a substantial positive air pressure may be created within said rocket reservoir and within said vessel, after which said rocket assembly may be released by said release means and may advance away from said housing by said pressurized air in said vessel and by jet propulsion of said liquid and air contained within said rocket reservoir.

2. The toy of claim 1, wherein said rocket assembly is a two piece assembly having an upper section which includes a nose cone containing said rocket reservoir and having a lower section which includes said jet tube.

3. The toy of claim 2, wherein said jet tube is removably connected to said upper section and includes a restricted outlet orifice to enhance jet propulsion upon launching.

4. The toy of claim 1, wherein said jet tube receiver includes a one way valve which inhibits the flow of liquid from said rocket reservoir to said launcher vessel but permits air to be pumped into said rocket reservoir.

5. The toy of claim 1, wherein said pump is a piston pump with a piston and chamber having a second one way valve, said second one way valve being connected to said piston.

6. The toy of claim 1, wherein said release means includes a depressible, spring loaded trigger.

7. The toy of claim 1, wherein said pump is connected by at least one flexible tube to said launcher vessel inlet so that said pump may be remotely located from said launcher and rocket assembly.

8. A liquid jet propelled rocket launcher and rocket toy, which comprises:

(a) a launcher having a housing which includes a base for resting on a horizontal surface, a vessel for holding a predetermined amount of air therein, a vessel air inlet, a vessel air outlet and said housing having a jet tube receiver connected to said vessel outlet and adapted to connect with a jet nozzle of a rocket assembly;

(b) a pump connected to said vessel inlet, said pump being connected for and capable of pumping pressurized air into said vessel, said pump being connected by one flexible tube to said launch vessel inlet and by another flexible tube to the releasing means recited below, so that said pump may be remotely located from said launcher and rocket assembly;

(c) a first one way valve connected to said pump and permitting flow of air only from said pump to said vessel inlet;

(d) a rocket assembly latch mechanism connected to either of said housing or rocket assembly;

(e) means for releasing said latch mechanism; and (f) a rocket assembly which includes a propulsion rocket reservoir for receiving liquid and subsequently receiving air under pressure from said pump, and a jet tube extending from said propulsion rocket reservoir and adapted to sealably and releasably connect with said jet tube receiver of said housing;

wherein said rocket assembly with said jet tube is releasably attachable to said housing with said jet tube coupled in fluid communication with said jet tube receiver by said latch mechanism, wherein liquid may be stored within said rocket propulsion reservoir, and air may be pumped into said rocket propulsion reservoir and into said launcher vessel by means of actuating said pump and further wherein a substantial positive air pressure may be created within said rocket propulsion reservoir and within said vessel, after which said rocket assembly may be released by said release means and may advance away from said housing by said pressurized air in said vessel and by jet propulsion of said liquid and air contained within said rocket propulsion reservoir.

9. The toy of claim 8, wherein said rocket assembly is a two piece assembly having an upper section which includes a nose cone containing said rocket propulsion reservoir and having a lower section which includes said jet tube.

10. The toy of claim 9, wherein said jet tube is removably connected to said upper section and includes a restricted outlet orifice to enhance jet propulsion upon launching.

11. The toy of claim 8, wherein said jet tube receiver includes a one way valve which inhibits the flow of liquid from said rocket propulsion reservoir to said launcher vessel but permits air to be pumped into said rocket propulsion reservoir.

12. The toy of claim 8, wherein said pump is a piston pump with a piston and chamber having a second one way valve, said second one way valve being connected to said piston.

13. The toy of claim 8, wherein said release means is a depressible, spring loaded trigger.

14. The toy of claim 8, wherein said pump is connected by more than one flexible tube to said launcher vessel inlet so that said pump may be remotely located from said launcher and rocket assembly.

15. A liquid jet propelled rocket launcher and rocket toy, which comprises:

(a) a launcher having a housing which includes a vessel for holding pressurized air therein, an inlet to said vessel and an outlet from said vessel, said inlet and said outlet being separate; said housing further comprising a jet tube receiver extending from said outlet and adapted to connect with a jet tube of a rocket assembly;

(b) a pump connected to said vessel inlet of said housing, said pump being connected for and capable of pumping air simultaneously into said vessel and into a rocket reservoir recited below and into a jet tube recited below, at a pressure sufficient to launch a rocket assembly;

(c) a first one way valve connected to said pump and permitting flow of air only from said pump to said vessel;

(d) a rocket assembly latch mechanism located on said housing;

(e) means for releasing said latch mechanism;

(f) a rocket assembly which includes a rocket reservoir for receiving liquid and subsequently receiving air under pressure from said pump by way of said launcher housing, a jet tube extending from said rocket reservoir and adapted to sealably and releasably connect to said jet tube receiver of said housing;

wherein said rocket assembly with said jet tube is releasably attachable to said housing with said jet tube coupled in fluid communication with said jet tube receiver by said latch mechanism, wherein liquid may be stored within said rocket reservoir, and air may be pumped into said rocket reservoir and into said launcher vessel by means of actuating said pump and further wherein a substantial positive air pressure may be created within said rocket reservoir and within said vessel, after which said rocket assembly may be released by said release means and may advance away from said housing by said pressurized air in said vessel and by jet propulsion of said liquid and air contained within said rocket reservoir, and further wherein said rocket assembly is a two piece assembly having an upper section which includes a nose cone containing said rocket reservoir and having a lower section which includes said jet tube.

16. The toy of claim 15, wherein said jet tube is removably connected to said upper section and includes a restricted outlet orifice to enhance jet propulsion upon launching.

17. The toy of claim 15, wherein said jet tube receiver includes a one way valve which inhibits the flow of liquid from said rocket reservoir to said launcher vessel but permits air to be pumped into said rocket reservoir.

18. The toy of claim 15, wherein said release means is a depressible, spring loaded trigger.

19. The toy of claim 15, wherein said pump is connected by at least one flexible tube to said launcher vessel inlet so that said pump may be remotely located from said launcher and rocket assembly.

20. The toy of claim 19, wherein said pump is connected by two flexible tubes, one of said two flexible tubes being connected to said launcher vessel inlet and a second of said two flexible tubes being connected to a launcher release inlet so that said pump may be remotely located from said launcher and rocket assembly.

* * * * *